United States Patent [19]

Inoguchi et al.

[11] Patent Number: 4,644,919

[45] Date of Patent: Feb. 24, 1987

[54] WARMING-UP SYSTEM OF A CAR ENGINE

[75] Inventors: Kenichi Inoguchi; Yoichi Iwakura, both of Oosaka; Jun Umehara, Oobu, all of Japan

[73] Assignees: Aisan Kogyo Kabushiki Kaisha, Aichi; Daihatsu Motor Company, Ltd., Osaka, both of Japan

[21] Appl. No.: 810,752

[22] Filed: Dec. 19, 1985

[30] Foreign Application Priority Data

Dec. 29, 1984 [JP] Japan ..... 59-276067

[51] Int. Cl.[4] ..... F02M 1/08

[52] U.S. Cl. ..... 123/438; 123/179 G; 123/180 E; 123/180 P

[58] Field of Search ..... 123/438, 491, 497, 499, 123/179 G, 179 L, 180 E, 180 P

[56] References Cited

U.S. PATENT DOCUMENTS

| | | | |
|---|---|---|---|
| 3,704,702 | 12/1972 | Aono | 123/491 |
| 4,184,460 | 1/1980 | Harada et al. | 123/491 |
| 4,249,496 | 2/1981 | Shimazaki et al. | 123/438 |
| 4,441,467 | 4/1984 | Powell | 123/179 G |
| 4,480,618 | 11/1984 | Kamifuji et al. | 123/438 |

*Primary Examiner*—Andrew M. Dolinar

*Attorney, Agent, or Firm*—Sixbey, Friedman & Leedom

[57] ABSTRACT

A warming-up system of an engine for an automobile according to the present invention is provided with main and auxiliary nozzles in an air intake passage of a carburetor. The auxiliary nozzle is connected to an electromagnetically-operated fuel resupply pump. The warming-up system is further provided with a position detector for determining whether or not a throttle valve is in an open position, a rotation detector for detecting the rotational frequency of the engine, and a control circuit for controlling the drive of the pump in accordance with signals from the detectors. Based on the rotational frequency of the engine detected by the rotation detector, the control circuit determines whether the engine is in a cranking state or in a complete detonation state. When the engine is in the complete detonation state, the control circuit drives the pump to supply a predetermined quantity of auxiliary fuel to the intake passage through the auxiliary nozzle. When the engine is in the complete detonation state and if the throttle valve is determined to be open, the control circuit drives the pump to supply a larger quantity of auxiliary fuel than that supplied from the pump in the complete detonation state.

6 Claims, 5 Drawing Figures

WARMING-UP SYSTEM OF A CAR ENGINE

BACKGROUND OF THE INVENTION

The present invention relates to a warming-up system adapted for use with a car engine, especially a gasoline engine of an automobile.

For smoother starting and more efficient warming-up of a gasoline engine at a low temperature, a richer air-fuel mixture should be supplied to combustion chambers of the engine. Therefore, a carburetor for supplying the air-fuel mixture to the combustion chambers is provided with a choke valve in the vicinity of its intake portion. The choke valve serves to constrict an air intake passage in the carburetor, thereby reducing the quantity of air fed into the combustion chambers of the engine. Thus, a rich air-fuel mixture can be fed into the combustion chambers by operating the choke valve.

The choke valve may be switched by manual or automatic remote control. When remotely operating the valve, however, it must be mechanically coupled to a manual control knob or an actuator by means of a linkage or the like. Accordingly, the mechanical arrangement surrounding the carburetor is complicated.

Conventionally known is a variable choke carburetor which does not require any choke valve. Also in the carburetor of this type, especially in starting and warming up the engine at a low temperature, a nozzle must be externally operated by means of a linkage so that the quantity of fuel injected through a main jet is increased to enrich the air-fuel mixture supplied to the combustion chambers. Requiring such a linkage, the variable choke carburetor, like the one using the choke valve, is inevitably surrounded by complicated mechanisms.

In a warming-up system using a conventional carburetor, if a throttle valve is opened to start an automobile while the engine is being warmed up, the air-fuel ratio of the air-fuel mixture supplied to the combustion chambers is lowered, causing a shortage of fuel supply to the engine. When starting the automobile in a warming-up mode, therefore, the engine hesitates to be driven, thereby lowering the running performance of the automobile. Accordingly, in the prior art warming-up system, a power jet passage is provided independently of a main jet passage in the carburetor. The power jet passage is adapted to be opened when the throttle valve is opened. When the engine shifts from warming-up mode to running mode, therefore, fuel can be injected into an intake passage through the power jet passage as well as the main jet passage. In this manner, the engine can be supplied with a necessary quantity of fuel for running. In the warming-up system with the power jet passage, however, additional elements, such as a power piston, power valve, etc., are required to operate the power jet passage as the throttle valve is opened and closed. Thus, the carburetor would be further complicated in construction.

SUMMARY OF THE INVENTION

The object of the present invention is to provide a warming-up system of a car engine, enjoying simple arrangements of a carburetor and other mechanisms surrounding the same, and ensuring a satisfactory operation even when starting an automobile while the engine is being warmed up from a low-temperature state.

In order to achieve the above object, a warming-up system of an engine according to the present invention comprises a carburetor housing including an air intake passage defined inside and a venturi portion formed at a part of the intake passage so as to reduce the cross-sectional area of the intake passage, a main nozzle for injecting fuel into the venturi portion of the carburetor housing, a throttle valve in the intake passage located on the lower-course side of the main nozzle and adapted to be shifted between a closed position where the intake passage is opened to a minimum degree and an open position where the intake passage is opened to a maximum degree, fuel resupply means for feeding auxiliary fuel into the intake passage, the fuel resupply means including an auxiliary nozzle disposed in the intake passage and an electromagnetically-operated fuel resupply pump for delivering the auxiliary fuel toward the auxiliary nozzle, rotation detecting means for detecting the rotational frequency of the engine and delivering an electrical rotation signal corresponding to the rotational frequency, position detecting means for determining whether or not the throttle valve is in the closed position, the position detecting means being adapted to deliver an electrical open signal when the throttle valve is in the open position, and control circuit means for controlling the drive of the fuel resupply pump in response to the signals from the rotation detecting means and the position detecting means, the control circuit means including a decision circuit for determining, in accordance with the rotation signal from the rotation detecting means, whether the engine is in a cranking state or whether the engine is in a complete detonation state such that the engine maintains its rotation for itself, and a driver circuit adapted to deliver a first drive signal for driving the fuel resupply pump to cause a predetermined quantity of auxiliary fuel to be injected from the auxiliary nozzle when the engine is determined to be in the complete detonation state by the decision circuit, and to deliver a second drive signal for driving the fuel resupply pump so that a larger quantity of auxiliary fuel than that injected from the auxiliary nozzle in accordance with the first drive signal is injected from the auxiliary nozzle when the engine is in the complete detonation state and if the open signal is supplied from the position detecting means.

According to the warming-up system of the invention, when the engine shifts from the cranking state to the complete detonation state, the fuel resupply pump is driven so that the auxiliary fuel is injected into the air intake passage through the auxiliary nozzle. Thus, a rich air-fuel mixture can be supplied to combustion chambers of the engine, so that the engine can enjoy improved starting performance for a satisfactory warming-up operation.

Since the fuel resupply pump used in the warming-up system of the invention is operated electromagnetically, it is unnecessary to arrange any mechanical means, such as a link mechanism for driving the pump, around the carburetor. Thus, the internal mechanical construction of an engine room may be simplified.

According to the warming-up system of the invention, moreover, if the throttle valve is opened while the engine is being warmed up, the fuel resupply pump is driven so as to inject a larger quantity of auxiliary fuel than that for warming-up into the intake passage. Therefore, if the quantity of intake air fed into the combustion chambers is increased as the valve is opened, the auxiliary fuel supplied to the intake passage can further be increased correspondingly. This prevents any hesitation in the drive of the engine and ensures a smooth operation. Accordingly, the automobile may be started with success even while the engine is being warmed up. Thus, it is possible to eliminate an accelerator pump which is adapted to be actuated only at the time of acceleration, as well as a power-operated fuel supply mechanism, including the power piston, power valve, etc., which are conventionally required for the prevention of the hesitation in driving the engine. In consequence, the warming-up system, as a whole, may further be simplified in construction.

Using the electromagnetically-operated fuel resupply pump, furthermore, the warming-up system of the invention can effectively control the operation of the pump for improved fuel-efficiency.

DETAILED DESCRIPTION OF THE PREFERRED EMBODIMENTS

Figure 1:
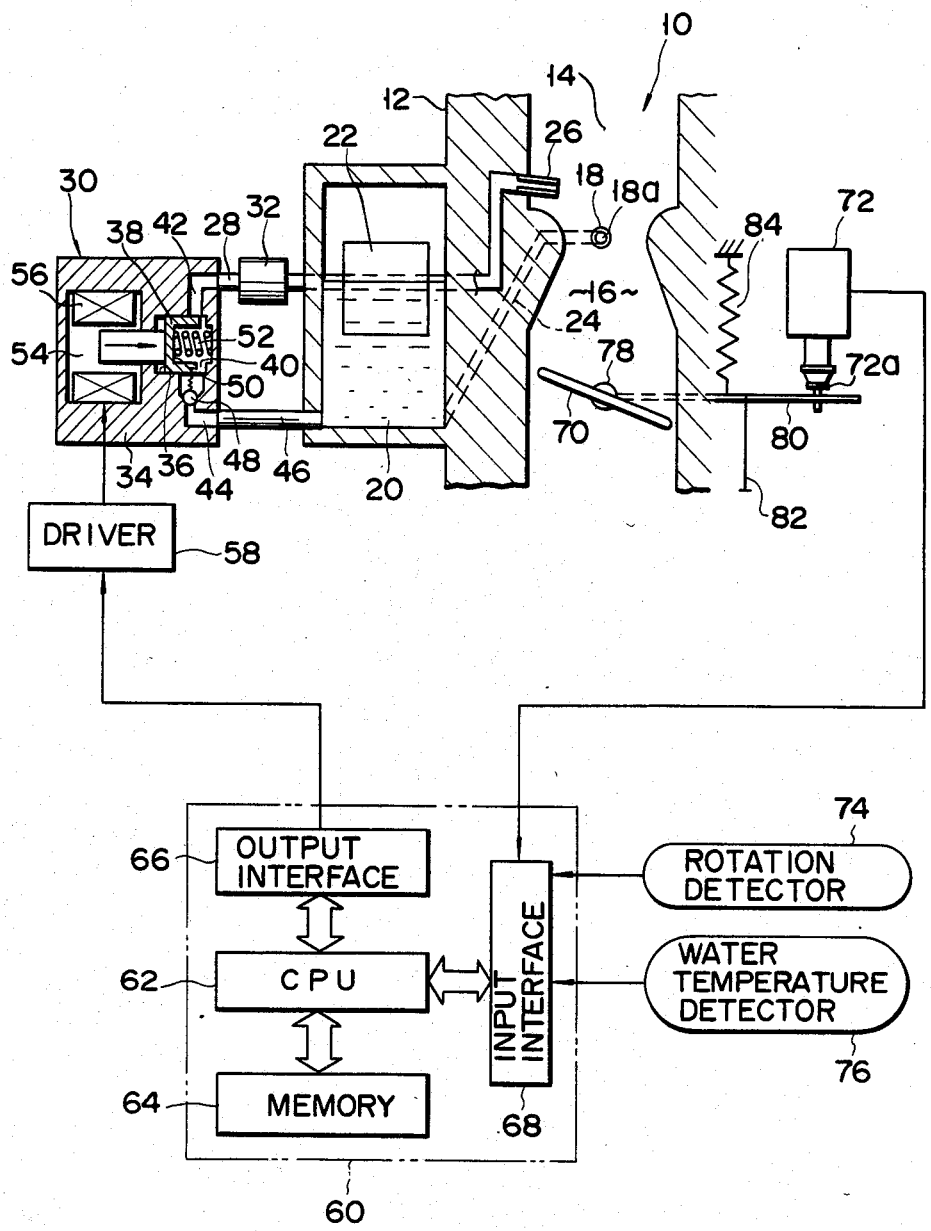
FIG. 1 is a schematic view of a warming-up system according to an embodiment of the present invention.

Referring now to FIG. 1, there is schematically shown a warming-up system of a gasoline engine for an automobile according to the present invention. The warming-up system is provided with carburetor 10. In FIG. 1, carburetor 10 is shown only partially. Carburetor 10 has housing 12 in which air intake passage 14 is defined. Passage 14 is connected at one end to an air cleaner for introducing the outside air. The other end of passage 14 is connected to a plurality of combustion chambers of the engine by means of an intake manifold (not shown). The air cleaner, manifold, and engine are not shown in FIG. 1.

Venturi portion 16 for reducing the cross-sectional area of intake passage 14 is formed in the middle of passage 14. Main nozzle 18 projects into portion 16.

Independent of intake passage 14, float chamber 20 is defined in housing 12. Fuel is stored in chamber 20. Float 22 is floated on the surface of the fuel. Float 22 serves to maintain a predetermined surface level of the fuel in chamber 20. A fuel port (not shown) of float chamber 20 is connected to a fuel supply pump (not shown). Disposed in the fuel port is a needle valve (not shown) which is adapted to open and close the port as float 22 moves up and down. Float chamber 20 is connected to nozzle 18 by means of passage 24 indicated by broken lines in FIG. 1. Thus, the fuel in chamber 20 is continually fed to port 18*a* of nozzle 18.

Auxiliary nozzle 26 projects into intake passage 14, located close to and on the upper-course side of main nozzle 18. Nozzle 26 is connected to fuel resupply pump 30 by means of fuel delivery pipe 28. Pipe 28 is provided with check valve 32 for preventing the fuel from flowing from nozzle 26 to pump 30.

Resupply pump 30 is a plunger pump which is operated electromagnetically. Pump 30 has pump housing 34 in which stepped cylinder chamber 36 is defined. Stepped plunger 38 is slidably fitted in cylinder chamber 38. Pump chamber 40 is defined between the end face of a large-diameter portion of plunger 38 and the inner end face of chamber 36 opposed thereto. Chamber 40 is connected to delivery pipe 28 by means of delivery passage 42 on one side, and to float chamber 20 via suction passage 44 and suction pipe 46 on the other side. Passage 44 is provided with check valve 48 for preventing the fuel from flowing from pump chamber 40 to float chamber 20.

Recess 50 is formed in the end face of the large-diameter portion of stepped plunger 38. Return coil spring 52 is interposed between the inner end face of recess 50 and the inner end face of stepped cylinder chamber 36 defining pump chamber 40. Spring 52 urges plunger 38 in a direction to increase the capacity of chamber 40. A small-diameter portion of plunger 38 protrudes into solenoid chamber 54 which is defined inside pump housing 34. Solenoid 56 is contained in chamber 54, surrounding the small-diameter portion of plunger 38. Solenoid 56 is electrically connected to driver 58 for applying pulse voltage to solenoid 56. If the pulse voltage from driver 58 is applied to solenoid 56 with predetermined pulse period F, solenoid 56 produces an electromagnetic force to attract plunger 38 against the urging force of return spring 52. Thus, plunger 38 is reciprocated in accordance with period F of the pulse voltage, so that the fuel supplied from float chamber 20 to pump chamber 40 is pulsatively injected, by a fixed amount (e.g., 0.04 cc) at a time, from auxiliary nozzle 26 into air intake passage 14 of carburetor 10 through fuel delivery passage 42 and fuel delivery pipe 28. Thus, according to fuel resupply pump 30 constructed in this manner, the amount of fuel delivered from pump 30 per unit time, i.e., the amount of fuel injected from nozzle 26, can be increased by shortening period F of the pulse voltage applied to solenoid 56. By lengthening period F, on the other hand, the injection quantity can be reduced.

Driver 58 is electrically connected to microcomputer 60 as a control circuit for controlling the drive of fuel resupply pump 30. Microcomputer 60 includes central processing unit (CPU) 62, memory 64 connected to CPU 62, output interface 66 for connecting CPU 62 and driver 58, and input interface 68 connecting CPU 62 and various detectors mentioned later.

Input interface 68 is supplied with detection signals from position detector 72, rotation detector 74, and water temperature detector 76. Detector 72 serves to determine whether throttle valve 70 disposed in intake passage 14 of carburetor 10 is open or not. Detector 74 detects the engine speed, while detector 76 detects the temperature of cooling water of the engine. Inside intake passage 14, throttle valve 70 is mounted on rotating shaft 78, located on the lower-course side of venturi portion 16. One end of rocking arm 80 is attached to shaft 78. Arm 80 extends at right angles to shaft 78, and its other end projects outward from housing 12 of carburetor 10. One end of wire 82 is connected to the projecting end of arm 80. The other end of wire 82 is connected to an accelerator pedal (not shown) of the automobile by means of a link mechanism (not shown). Also, urging spring 84 is coupled to the projecting end of rocking arm 80. Spring 84 urges arm 82 to rock so that valve 70 is closed as shown in FIG. 1. When the accelerator pedal is worked, arm 80 is rocked by wire 82 against the urging force of spring 84, so that valve 70 is opened.

Position detector 72 has contact maker 72*a* which can come into contact with the projecting end of rocking arm 80 of throttle valve 70. When contact maker 72*a* is in contact with arm 80, that is, when valve 70 is closed, as shown in FIG. 1, detector 72 delivers ON signal $S_1$ to input interface 68. When valve 70 is opened so that arm 80 is disengaged from contact maker 72*a*, detector 72 delivers OFF signal $S_2$ to interface 68.

Rotation detector 74 detects the rotational frequency of the engine from, e.g., the frequency of pulse voltage applied to an ignition coil (not shown) of the engine, and delivers a rotation signal corresponding to the rotational frequency to input interface 68. Water temperature detector 76 includes, for example, a thermistor (not shown) for converting the cooling water temperature into an analog electric signal, and an analog-to-digital converter (not shown) for converting the output of the thermistor into a digital electric signal and applying cooling water temperature signal T to interface 68.

Microcomputer 60 logically processes the detection signals supplied from the detectors to input interface 68, and delivers a control signal for controlling the drive of fuel resupply pump 30, that is, period signal for determining pulse period F of the pulse voltage applied from driver 58 to solenoid 56 of pump 30, to driver 58 through output interface 66. Microcomputer 60 is stored with a program for determining pulse period F in accordance with the flow chart of FIG. 2. Referring now to FIGS. 2 to 5, the operation of the warming-up system of the present invention will be described.

Figure 2:
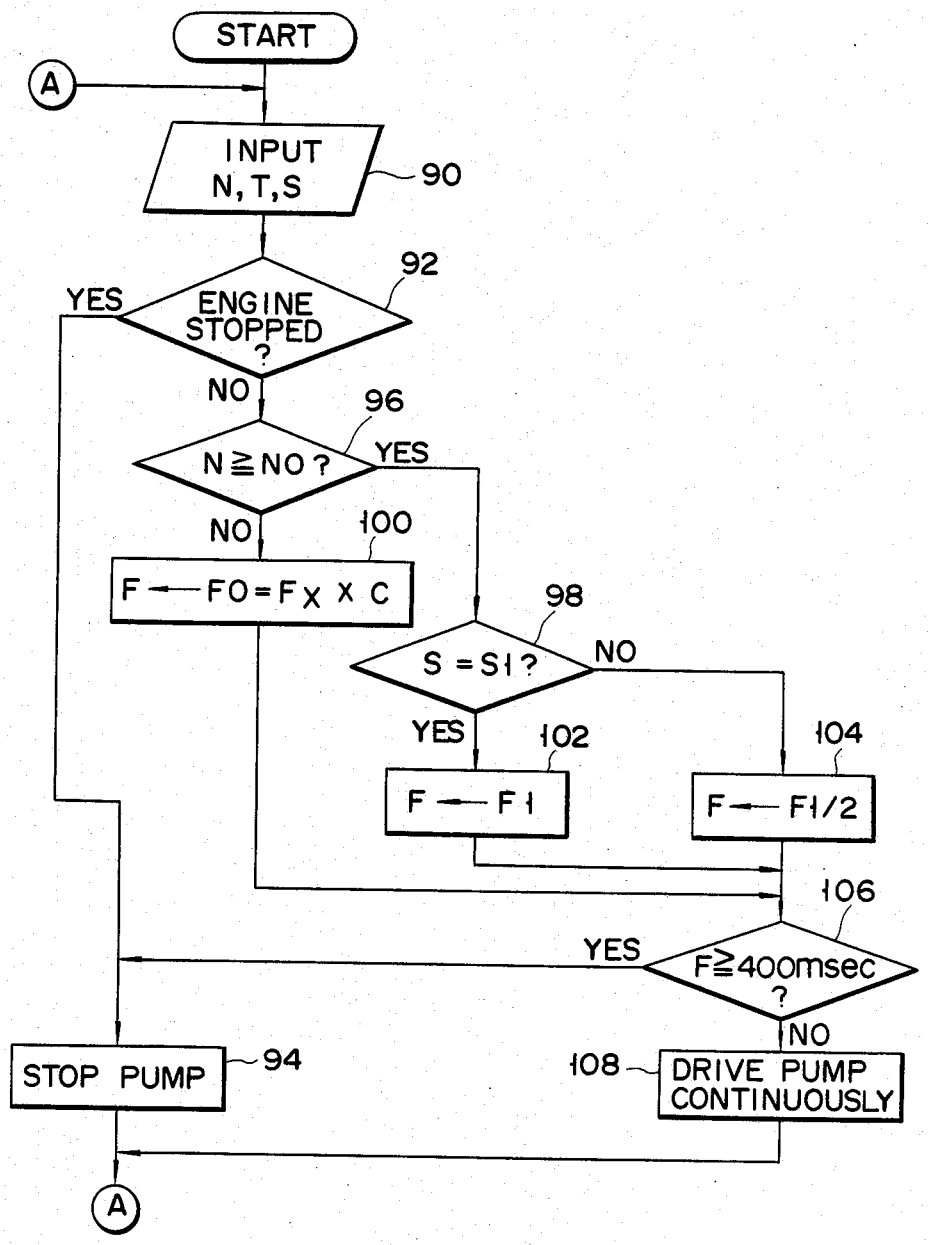
FIG. 2 is a flow chart for illustrating the operation of a control circuit used in the warming-up system of FIG. 1.

In step 90 shown in FIG. 2, input interface 68 of microcomputer 60 is supplied with rotation signal N from rotation detector 74 responsive to the rotational frequency of the engine, cooling water temperature signal T from water temperature detector 76, and ON or OFF signal $S_1$ or $S_2$ from position detector 72. Then, in step 92, whether the engine is stopped or not is determined by rotation signal N. If the engine is found to be stopped in step 92, step 94 is entered. If not, that is, if the engine is found to be rotating, step 96 is entered. In step 94, the drive of fuel resupply pump 30 is stopped.

In step 96, whether or not the level of rotation signal N is equal to or higher than complete-detonation reference value $N_O$ of the engine is determined. Reference value $N_O$ serves as a criterion for determining whether the engine is being externally rotated by a starting motor (not shown), that is, in a cranking state, or whether the engine is rotating unaided, that is, in a complete detonation state. For example, reference value $N_O$ is adjusted to a value corresponding to the rotational frequency of the engine ranging from 440 rpm to 800 rpm. If it is concluded in step 96 that the level of rotation signal N is not less than reference value $N_O$, that is, the engine is undergoing complete detonation, step 98 is entered. If the level of signal N is found to be less than value $N_O$, that is, if the engine is in the cranking state, step 100 is entered.

Figure 3:
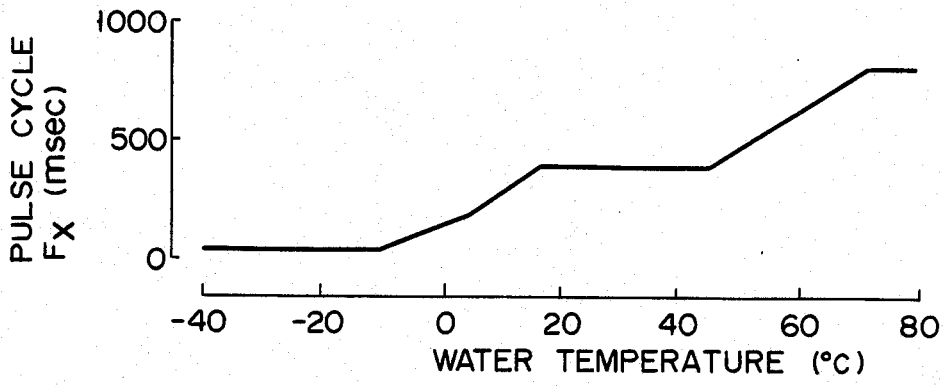
FIGS. 3 to 5 are diagrams for illustrating several criteria used in the control circuit.
Figure 4:
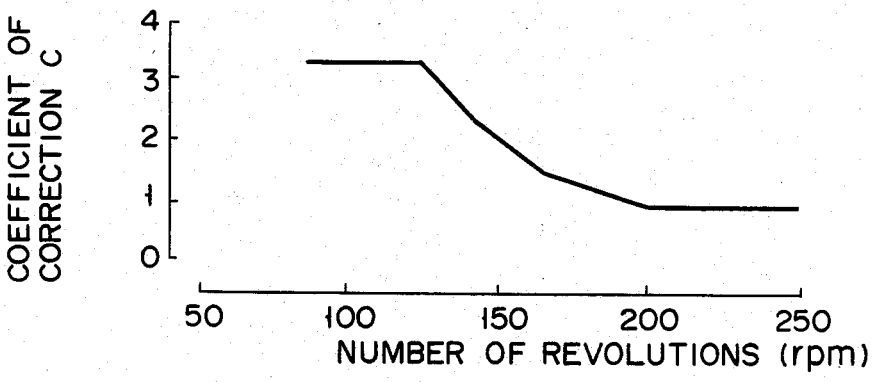

In step 100, pulse period F of the pulse voltage applied to solenoid 56 of fuel resupply pump 30 is adjusted to $F_O$. Value $F_O$ is a value which is obtained by multiplying optimum pulse period $F_X$ for cranking by coefficient of correction C, that is, $F_O = F_X \times C$. Period $F_X$ depends on the cooling water temperature of the engine as a parameter, as shown in FIG. 3. In other words, period $F_X$ for cranking is determined so that air intake passage 14 of carburetor 10 is supplied, from pump 30 through auxiliary nozzle 26, with auxiliary fuel necessary for the engine to quickly shift from cranking state to complete detonation. Also, optimum period $F_X$ corresponding to the cooling water temperature is mapped and stored in memory 64 of microcomputer 60. Coefficient of correction C is used in correcting irregularity of the air-fuel ratio attributed to variations of the rotational frequency of the engine in the cranking state. The value of coefficient C is obtained with use of the engine speed as a parameter, as shown in FIG. 4, and is also mapped and stored in memory 64 of microcomputer 60. Thus, in microcomputer 60, pulse period $F_X$ and coefficient of correction C for cranking are calculated on the basis of rotation signal N and water temperature signal T inputted in step 90. The value of pulse period FO for the drive of fuel resupply pump 30 is determined by these values. Thereupon, a signal for energizing solenoid 56 of pump 30 is delivered from output interface 66 of microcomputer 60 to driver 58, so that pump 30 is driven with pulse period $F_O$. As a result, a necessary quantity of auxiliary fuel is supplied from pump 30 to intake passage 14 of carburetor 10 through auxiliary nozzle 26. Thus, a rich air-fuel mixture can be fed into the combustion chambers of the engine. This facilitates the engine to quickly shift from cranking state to complete detonation state, thereby improving the starting characteristic of the engine.

In step 98, whether ON-Off signal S from position detector 72 is ON signal $S_1$ or not. If ON signal $S_1$ is detected or if throttle valve 70 is found to be closed in step 98, step 102 is entered. If OFF signal $S_2$ is detected or if valve 70 is found to be open in step 98, step 104 is entered.

Figure 5:
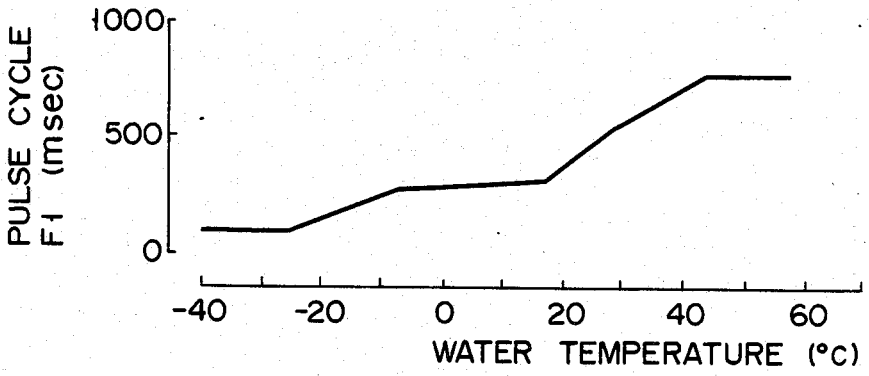

In step 102, pulse period F of the pulse voltage applied to solenoid 56 of fuel resupply pump 30 is adjusted to optimum period $F_1$ for warming up the engine. Pulse period $F_1$ is obtained with use of the the cooling water temperature of the engine as a parameter, as shown in FIG. 5, and is also mapped and stored in memory 64 ot microcomputer 60. Thus, in microcomputer 60, optimum period $F_1$ for warming-up is determined in accordance with water temperature signal T inputted in step 90. In this case, therefore, pump 30 is driven with pulse period $F_1$.

In step 104, on the other hand, pulse period F is adjusted to $F_1/2$. In this case, therefore, fuel resupply pump 30 is driven with pulse period $F_2$ equivalent to $F_1/2$ ($F_2 = F_1/2$).

As seen from the description in connection with steps 102 and 104, when the engine is in the complete detonation state and if throttle valve 70 is closed (step 102), fuel resupply pump 30 is driven with pulse period $F_1$, and an air-fuel mixture with a necessary air-fuel ratio for warming-up is supplied to the combustion chambers of the engine. When the engine is in the complete detonation state and if throttle valve 70 is open (FIG. 4), that is, when working the accelerator pedal to run the automobile, pump 30 is driven with pulse period $F_2$ which is half as long as period $F_1$. Thus, in starting the automobile while the engine is being warmed up, a quantity of fuel twice that for warming-up can be injected from pump 30 to intake passage 14 of carburetor 10 through auxiliary nozzle 26. In this case, therefore, the combustion chambers of the engine can be supplied with an air-fuel mixture rich enough for the drive of the automobile. Thus, the automobile can be started without any hesitation in driving the engine, thus enjoying improved running performance.

As shown in FIG. 2, any of steps 100, 102 and 104 is followed by step 106. In step 106, whether or not pulse period F for the drive of fuel resupply pump 30 is shorter than 400 msec is determined. If period F is determined to be not shorter than 400 msec in step 106, step 94 is entered. In step 94, the drive of pump 30 is stopped. If period F is longer than 400 msec, the cooling water temperature of the engine is about 20° C. or more, as shown in FIGS. 3 and 5. In this case, therefore, the combustion chambers of the engine should not be considered to require fuel supply any more. Moreover, even though pump 30 is driven with a period of 400 msec or more, the supply of the auxiliary fuel to intake passage 14 of carburetor 10 is practically negligible. Therefore, the drive of pump 30 can be stopped without hindrance.

If pulse period F is determined to be shorter than 400 msec in step 106, on the other hand, it is concluded that the cooling water of the engine is at a temperature such that the engine still requires warming-up, and step 108 is entered. In step 108, fuel resupply pump 30 continues to be driven with the predetermined pulse period, and step 90 is resumed. Thereafter, the above-mentioned steps are repeated.

According to the warming-up system of the present invention, as described above, the starting and warming-up performance of the engine can be improved with use of a simple construction. When starting the automobile while the engine is being warmed up, moreover, the engine can be driven without hesitation, ensuring improved running performance of the automobile.

The present invention is not limited to the embodiment described above. In the above embodiment, for example, the quantity of auxiliary fuel supplied from fuel resupply pump 30 is increased to twice the quantity for warming-up when throttle valve 70 is opened during the warming-up of the engine. However, the auxiliary fuel supply may suitably be increased according to the type and size of the engine.

In the aforementioned embodiment, moreover, the quantity of auxiliary fuel supplied from pump 30 is described as being variable with the cooling water temperature of the engine. It is to be understood, however, that the invention is not limited to this arrangement.

What is claimed is:

1. A warming-up system of a car engine comprising:

a carburetor housing including an air intake passage defined inside and a venturi portion formed at a part of the intake passage so as to reduce the cross-sectional area of the intake passage;

a main nozzle for injecting fuel into the venturi portion of the carburetor housing;

a throttle valve in the intake passage located on the lower-course side of the main nozzle and adapted to be shifted between a closed position where the intake passage is opened to a minimum degree and an open position where the intake passage is opened to a maximum degree;

fuel resupply means for feeding auxiliary fuel into the intake passage, said fuel resupply means including an auxiliary nozzle disposed in the intake passage and an electromagnetically-operated fuel resupply pump for delivering the auxiliary fuel toward the auxiliary nozzle;

rotation detecting means for detecting the rotational frequency of the engine and delivering an electrical rotation signal corresponding to the rotational frequency;

position detecting means for determining whether or not the throttle valve is in the closed position, said position detecting means being adapted to deliver an electrical open signal when the throttle valve is in the open position; and control circuit means for controlling the drive of the fuel resupply pump in response to the signals from the rotation detecting means and the position detecting means, said control circuit means including a decision circuit for determining, in accordance with the rotation signal from the rotation detecting means, whether the engine is in a cranking state or whether the engine is in a complete detonation state such that the engine maintains its rotation for itself, and a driver circuit adapted to deliver a first drive signal for driving the fuel resupply pump to cause a predetermined quantity of auxiliary fuel to be injected from the auxiliary nozzle when the engine is determined to be in the complete detonation state by the decision circuit, and to deliver a second drive signal for driving the fuel resupply pump so that a larger quantity of auxiliary fuel than that injected from the auxiliary nozzle in accordance with the first drive signal is injected from the auxiliary nozzle when the engine is in the complete detonation state and if the open signal is supplied from the position detecting means.

2. The warming-up system according to claim 1, wherein said fuel resupply pump includes a plunger having a pumping function and a solenoid for driving the plunger, and the first and second drive signals delivered from the drive circuit determine the period of a pulse voltage supplied to the solenoid of the fuel resupply pump.

3. The warming-up system according to claim 2, wherein the second drive signal drives the fuel resupply pump so that the quantity of auxiliary fuel delivered from the pump is twice that delivered in response to the first drive signal.

4. The warming-up system according to claim 3, wherein said control circuit means further includes a water temperature detector for detecting the temperature of cooling water of the engine, and the first drive signal delivered from the drive circuit varies the period of the pulse voltage applied to the solenoid of the fuel resupply pump, in accordance with a water temperature signal from the water temperature detector.

5. The warming-up system according to claim 4, wherein said control circuit means further includes a second drive circuit adapted to deliver a third drive signal for applying a pulse voltage with a predetermined period to the solenoid of the fuel resupply pump when the engine is determined to be in the cranking state by the decision circuit.

6. The warming-up system according to claim 5, wherein the period of the applied pulse voltage to the solenoid of the fuel resupply pump, determined by the third drive signal, varies in accordance with the water temperature signal from the water temperature detector and the rotation signal from the rotation detecting means.

* * * * *